US010150647B2

(12) United States Patent
Huber et al.

(10) Patent No.: US 10,150,647 B2
(45) Date of Patent: Dec. 11, 2018

(54) SYSTEM FOR CONTROLLING AND CONFIGURATION OF AN OCCUPANT EVACUATION OPERATION IN A BUILDING

(71) Applicant: Siemens Schweiz AG, Zurich (CH)

(72) Inventors: Andreas Huber, Flurlingen (CH); Axel Kunze, Zurich (CH)

(73) Assignee: SIEMENS SCHWEIZ AG, Zurich (CH)

( * ) Notice: Subject to any disclaimer, the term of this patent is extended or adjusted under 35 U.S.C. 154(b) by 32 days.

(21) Appl. No.: 15/387,830

(22) Filed: Dec. 22, 2016

(65) Prior Publication Data

US 2018/0179022 A1 Jun. 28, 2018

(51) Int. Cl.

| | |
|---|---|
| ***B66B 5/24*** | (2006.01) |
| ***B66B 3/00*** | (2006.01) |
| ***B66B 5/02*** | (2006.01) |
| ***G08B 7/06*** | (2006.01) |
| ***B66B 5/00*** | (2006.01) |

(52) U.S. Cl.
CPC ..... *B66B 5/024* (2013.01); *B66B 5/0006* (2013.01); *G08B 7/066* (2013.01); *B66B 2201/00* (2013.01)

(58) Field of Classification Search
CPC ..... B66B 5/024; B66B 5/021; B66B 3/006; G08B 25/00; G08B 29/02
See application file for complete search history.

(56) References Cited

U.S. PATENT DOCUMENTS

| | | | | |
|---|---|---|---|---|
| 5,979,607 | A | 11/1999 | Allen | 187/390 |
| 7,025,179 | B2 * | 4/2006 | Shih | B66B 5/027 187/290 |
| 2004/0163325 | A1 | 8/2004 | Parrini et al. | 52/1 |
| 2005/0108038 | A1 | 5/2005 | Cober et al. | 705/324 |
| 2008/0302609 | A1 * | 12/2008 | Siikonen | B66B 5/021 187/247 |
| 2009/0027225 | A1 * | 1/2009 | Farley | G08B 7/06 340/6.11 |
| 2009/0138353 | A1 * | 5/2009 | Mendelson | G01C 21/206 705/14.39 |

(Continued)

FOREIGN PATENT DOCUMENTS

WO 2015/187775 A1 12/2015 ..... A62B 99/00

*Primary Examiner* — Marlon Fletcher
(74) *Attorney, Agent, or Firm* — Slayden Grubert Beard PLLC

(57) ABSTRACT

A system for controlling and configuration of an occupant evacuation operation (OEO) in a multi-story building has an elevator control system, a fire alarm detection system with a plurality of fire sensor devices, wherein the fire alarm detection system generates fire alarm information signals, and a central control system coupled with the elevator control system and the fire alarm detection system. The central control system has a data processing system with a processor and memory which provide a configurable model of the multi-story building, receive signals from the fire alarm detection system and receive signals and transmit control signals from/to the elevator control system. The configurable model allows configuration of the system creating a model of the functionalities in the multi-story building required for the OEO, and the central control system controls the OEO based on the signals received from the fire alarm detection system and the elevator control system.

30 Claims, 7 Drawing Sheets

(56) References Cited

U.S. PATENT DOCUMENTS

| | | | | |
|---|---|---|---|---|
| 2011/0024239 | A1* | 2/2011 | Kocher | B66B 5/027<br>187/249 |
| 2011/0155516 | A1* | 6/2011 | Mason | B66B 5/021<br>187/384 |
| 2011/0272221 | A1* | 11/2011 | Iwata | B66B 5/021<br>187/384 |
| 2013/0169817 | A1* | 7/2013 | Jones | G08B 25/14<br>348/159 |
| 2014/0132393 | A1* | 5/2014 | Evans | G08B 21/02<br>340/6.11 |

* cited by examiner

300

- 1:OEO control group | Elevator group 1
  - Common OEO control | General settings & functions
    - 1:Causes 'Phase I recall' | Phase I recall
      - 2:Section | Mass notification
      - 3:Automatic alarm zone | Elev.shaft/mach.room, group 1
      - 4:Automatic alarm zone | Elevator lobby, floor 8, group 1
      - 5:Automatic alarm zone | Elevator lobby, floor 7, group 1
      - 6:Automatic alarm zone | Elevator lobby, floor 6, group 1
      - 7:Automatic alarm zone | Elevator lobby, floor 5, group 1
      - 8:Automatic alarm zone | Elevator lobby, floor 4, group 1
      - 9:Automatic alarm zone | Elevator lobby, floor 1, group 1
      - 10:Automatic alarm zone | Elevator lobby, ground floor, group 1
      - 11:Automatic alarm zone | Elevator lobby, floor -1, group 1
    - 2:Causes 'OEO unavailable' | OEO unavailable
      - 1:FDCIO422 (class B)/Class B circuit/Input 'OEO unavailable'
    - 0:Causes 'Total building evacuation' | Total building evacuation
      - 1:FDCIO422 (class B)/Class B circuit/Input 'Total building evacuation'
  - 11:OEO building level | Served by elevator | Floor 8
  - 10:OEO building level | Served by elevator | Floor 7
    - Causes
      - 1:Section | Floor 7
  - 9:OEO building level | Served by elevator | Floor 6
  - 8:OEO building level | Served by elevator | Floor 5
  - 7:OEO building level | Served by elevator | Floor 4
  - 6:OEO building level | NOT served by elevator | Floor 3
  - 5:OEO building level | NOT served by elevator | Floor 2
  - 4:OEO building level | Served by elevator | Floor 1
  - 3:OEO building level | Discharge level | Ground floor (discharge level)
  - 2:OEO building level | Served by elevator | Floor -1
  - 1:OEO building level | NOT served by elevator | Floor -2

*Figure 3*

SYSTEM FOR CONTROLLING AND CONFIGURATION OF AN OCCUPANT EVACUATION OPERATION IN A BUILDING

TECHNICAL FIELD

The present disclosure relates to control systems within a building, in particular to the control and configuration of Occupant Evacuation Operations (OEO).

BACKGROUND

Until now, elevators in a building could not be used in case of fire. Generally, in many existing buildings, in case of fire, all elevators are recalled to a designated floor and can only be used by firefighters. Occupants need exit via stairs only. Signage and Fire alarm voice messages are issued accordingly. Because of the 9/11 event in New York, new codes and guidelines were developed which allow evacuation using elevators if a building infrastructure complies with specific rules. Such an Occupant Evacuation Operation (OEO) is for example defined in relevant codes for OEO, such as National Elevator Code ASME 17.1/CSA B44, Fire Alarm Codes NFPA 72 and others (US Building & Fire Codes, Local Codes, etc). Other countries may have different regulations.

The new US standards and regulations for the Occupant Evacuation Operation (OEO) require that the fire detection system evaluates when a specific level of a building is in an OEO relevant alarm status and when in evacuation status. This information shall be provided to the elevator system which may comprise multiple elevator banks and associated elevator controls. Furthermore, a close coordination between the voice evacuation messages and all the information displayed by the elevator system is absolutely required.

Conventional OEO implementations often require one or more control units which may be placed on each floor of a building or may control multiple floors and being connected with an elevator system which increases the cable connections significantly and thereby also increases system failures due to connection problems. At least one problem of such conventional systems is that they require many complex, manually configured generic control functions which are likely to be outdated and therefore need to be changed when something in the building changes. Those manually configurable generic control functions may comprise logic combinations of all relevant states with Boolean functions etc. These controls then activate hard-wired outputs which are connected to the elevator system.

Due to the complexity of such systems, in particular for multi-floor buildings, such as, e.g., skyscrapers, configuration and expansion of such systems is not easy. In particular, changes in regulation may require a reconfiguration of such a system that may not be easily achievable and require hardware changes or substitutions. Moreover, different countries may have different regulations and requirements for handling emergency situations in a building and associated OEOs. Thus, different customized systems may be necessary to comply with different regulation. Most importantly, changes in the usage of rooms/building parts and constructional changes may occur. It remains very difficult to adapt conventional systems to such changes.

SUMMARY

Hence, there exists a need for a configurable system that allows for easy adaptation to a specific building structure and to regulation with respect to the handling of emergency situation in such a building. Furthermore, the immense cabling requirement of conventional systems needs to be avoided.

According to an embodiment, a system for controlling and configuration of an occupant evacuation operation in a multi-story building, may comprise an elevator control system, a fire alarm detection system comprising a plurality of fire sensor devices, wherein the fire alarm detection system generates fire alarm information signals, and a central control system coupled with the elevator control system and the fire alarm detection system, wherein the central control system comprises a data processing system comprising a processor and memory operable to provide a configurable model of the multi-story building, to receive signals from said fire alarm detection system and to receive signals and transmit control signals from/to the elevator control system, wherein the configurable model allows configuration of the system creating a model of the functionalities in the multi-story building required for the occupant evacuation operation, and wherein the central control system controls the occupant evacuation operation (OEO) based on the signals received from the fire alarm detection system and the elevator control system.

According to a further embodiment, the central control system may comprise a network connection and the configurable model can be configured using an off-line engineering tool and is downloaded after configuration into the central control system through said network connection. According to a further embodiment, the central control system may provide control signals for the elevator system, wherein based on the control signals, the elevator system controls an evacuation procedure and a signage for the elevators. According to a further embodiment, the signage may comprise visual information. According to a further embodiment, the fire alarm system may comprise a voice evacuation system. According to a further embodiment, the fire alarm system can be an integrated part of the central control system. According to a further embodiment, the elevator system may comprise a plurality of independently controlled elevator groups. According to a further embodiment, the fire alarm detection system may comprise fire alarm detectors for each building level. According to a further embodiment, the system may further comprise fire alarm detectors coupled with the fire alarm system and located at least in one of: an elevator engine room, an elevator shaft, and an elevator lobby. According to a further embodiment, the central control system can be coupled with the elevator system through a BACnet network connection. According to a further embodiment, the central control system may provide input signals to the elevator system and receive digital output signals from the elevator system. According to a further embodiment, the central control system may comprise at least one configurable OEO control group module related to an elevator group coupled with a common OEO control module and a plurality of OEO building level control modules. According to a further embodiment, the fire alarm detection system may provide signals to the common OEO control module and each OEO building level control module. According to a further embodiment, the system may comprise a plurality of configurable OEO control group modules each related to one of a plurality of elevator groups, wherein each OEO control group module is further coupled with an associated common OEO control module and associated OEO building level control modules. According to a further embodiment, a common OEO control module associated with one of the OEO control group modules may provide signals for another common OEO control module associated with another OEO control group module. According to a further embodiment, a configuration screen for configuring the model of the multi-story building shows configuration in a tree structure, wherein a root element represents a OEO control group module and elements representing the common OEO control module and the OEO building level control modules branch from said root element, wherein the OEO building level control modules are arranged in the tree structure showing a highest building level on the top and a lowest building level on the bottom. According to a further embodiment, the configuration screen allows to assign input signals to cause predefined events. According to a further embodiment, each module for a building level evaluates and provides the following states: a) a first state indicating that an OEO relevant alarm has occurred on the building level; b) a second state indicating that the building level shall be evacuated with OEO; c) a third state indicating that the building level should be evacuated with OEO but no elevator is available; d) a fourth state indicating that OEO is active within the elevator group but this level is currently not being evacuated; and e) a fifth state indicating none of the states a) . . . d) is currently active.

According to another embodiment, a method for controlling and configuration of an occupant evacuation operation (OEO) in a multi-story building, may comprise the steps: configuring a model representing the multi-story building with an engineering tool, wherein the model represents and provides configuration of all building levels and associations with at least one elevator system and control signals; installing the configured model in a central control system coupled with an elevator control system and a fire alarm detection system within the building, wherein the central control system comprises a data processing system comprising a processor and memory operable to execute an OEO control based on the configured model, and receiving signals from said fire alarm detection system and receiving signals and transmitting control signals from/to the elevator control system, wherein the central control system controls the occupant evacuation operation (OEO) based on the signals received from the fire alarm detection system and the elevator control system.

According to a further embodiment of the above method, the model may comprise a common OEO control for which a plurality of input signals can be assigned to predefined events. According to a further embodiment of the above method, the method may further comprise modifying the configured model with an engineering tool to adapt the system to changes in the OEO as defined by a modified regulation or in order to adapt to changed building usage or constructional changes. According to a further embodiment of the above method, the method may further comprise providing control signals by the central control system for the elevator system, wherein based on the control signals, the elevator system controls an evacuation procedure and a signage for the elevators. According to a further embodiment of the above method, the signage may comprise visual information. According to a further embodiment of the above method, the method may further comprise generating voice evacuation messages for each building level. According to a further embodiment of the above method, the elevator system may comprise a plurality of independently controlled elevator groups. According to a further embodiment of the above method, the fire alarm detection system may comprise fire alarm detectors for each building level. According to a further embodiment of the above method, the method may further comprise arranging fire alarm detectors coupled with the fire alarm system at least in one of: an elevator engine room, an elevator shaft, and an elevator lobby. According to a further embodiment of the above method, the central control system may comprise at least one configurable OEO control group module related to an elevator group and a plurality of OEO building level control modules. According to a further embodiment of the above method, the at least one configurable OEO control group module may be coupled with a common OEO control module. According to a further embodiment of the above method, the method may further comprise providing signals by the fire alarm detection system to the common OEO control module and each OEO building level control module. According to a further embodiment of the above method, the method may further comprise a plurality of configurable OEO control group modules each related to one of a plurality of elevator groups, wherein each OEO control group module is further coupled with an associated common OEO control module and associated OEO building level control modules. According to a further embodiment of the above method, a common OEO control module associated with one of the OEO control group modules may provide signals for another common OEO control module associated with another OEO control group module. According to a further embodiment of the above method, a configuration screen for configuring the model of the multi-story building may show configuration in a tree structure, wherein a root element represents a OEO control group module and elements representing the common OEO control module and the OEO building level control modules branch from said root element, wherein the OEO building level control modules are arranged in the tree structure showing a highest building level on the top and a lowest building level on the bottom. According to a further embodiment of the above method, the configuration screen may allow to assign input signals to cause predefined events. According to a further embodiment of the above method, each module for a building level may evaluate and provide the following states: a) a first state indicating that an OEO relevant alarm has occurred on the building level; b) a second state indicating that the building level shall be evacuated with OEO; c) a third state indicating that the building level should be evacuated with OEO but no elevator is available; d) a fourth state indicating that OEO is active within the elevator group but this level is currently not being evacuated; and e) a fifth state indicating none of the states a) . . . d) is currently active.

BRIEF DESCRIPTION OF THE DRAWINGS

FIG. 3 shows a more specific block diagram of a coupling of a central control unit running the software model with an elevator control unit.

DETAILED DESCRIPTION

Figure 1:
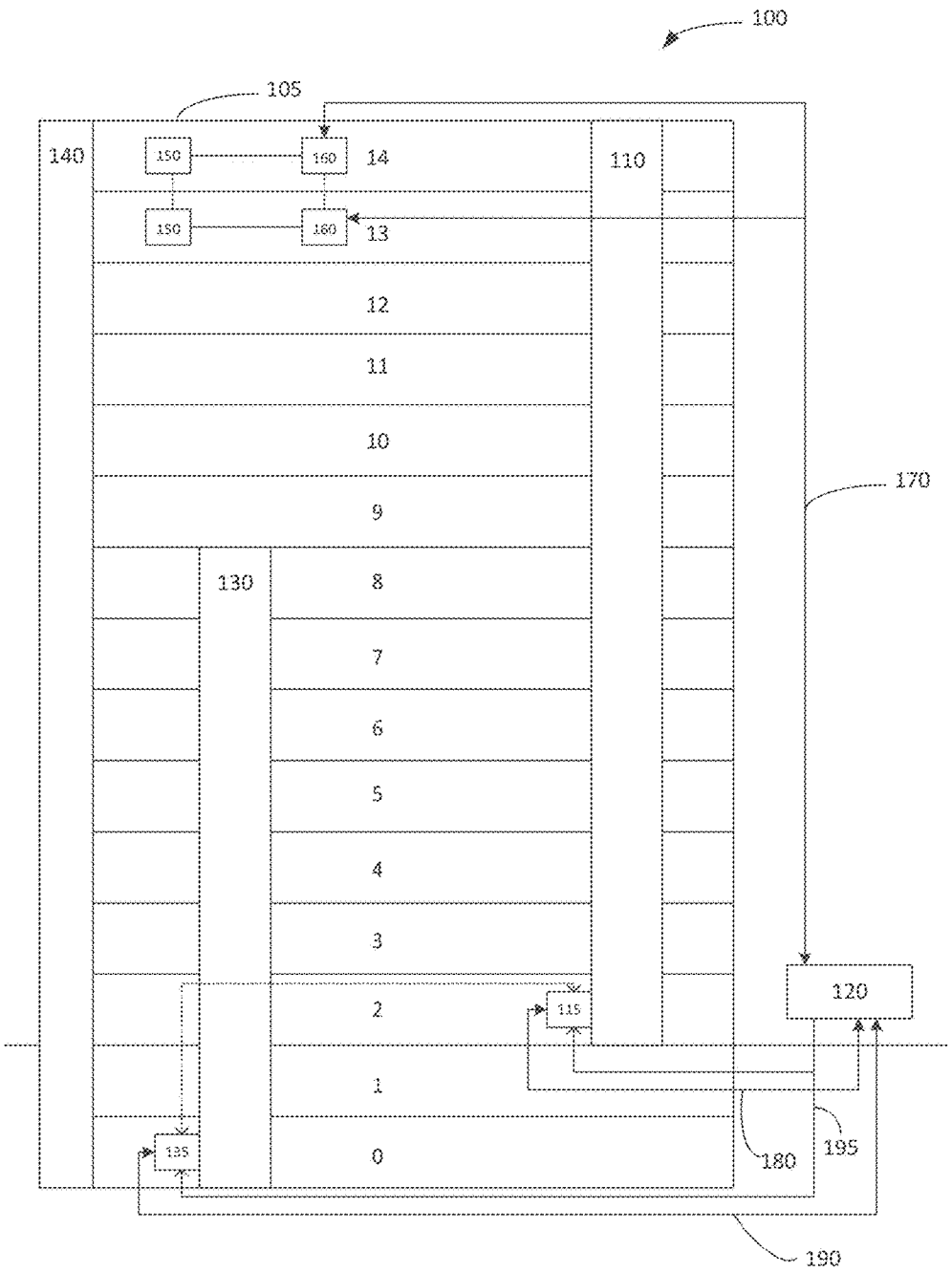
FIG. 1 shows an exemplary multi-level building.

The main requirements for an Occupant Evacuation Operation (OEO) are that automatic detectors shall activate the OEO, wherein a first alarm sets a fire alarm state within the building level, e.g. setting it into an 'OEO alarm' state.

Such an alarm state indicates that the respective building level needs to be evacuated with highest priority. Furthermore, two levels above as well as 2 levels below that level will also set in into an evacuation state, e.g. an 'OEO evac' state. Subsequent alarms set all levels between the respective level of a newly reported alarm and the level of the first alarm into an evacuation state and into an 'OEO evac' state. Furthermore, the two levels above as well as two levels below the level of the newly reported alarm are also set into evacuation mode and 'OEO evac' state. The levels in state 'OEO alarm' need to be evacuated with high priority than the ones in state 'OEO evac'. Manual pull stations must not activate the OEO. An alarm on the discharge level shall not activate the OEO.

In order to ensure a smooth & reliable evacuation, a close coordination between the Elevator system and the Fire alarm system is crucial. The various embodiments disclosed ensure that there is only one source of information (provided by the fire alarm system) which is used by all relevant control systems (fire alarm system, elevator system) but the evacuation procedure and the signage for the elevators is done by the elevator system. The system coordinates the evacuation procedure and signage by Elevator control. In addition, appropriate voice messages/evacuation instructions are issued by the fire alarm system.

According to various embodiments, a dedicated control application evaluates the OEO status of each building level and reports the status on dedicated communication lines and communication busses, e.g., via the standardized Building Automation and Control Network (BACnet) connection. Only the signals from/to the elevator system which are required by code are hard-wired, everything else is communicated via the standardized BACnet communication bus. OEO states are used as criteria for Voice messages.

Thus, a single central source of information for all relevant applications is provided according to various embodiments to provide control for the elevators and voice messages as well as other indication means. This solution provides for a minimum number of connections between elevator system and fire alarm system and the major part of information is provided via a high level connection. In other words, the central control system creates a model of the functionalities in a building that are necessary for an OEO. The central control system may according to an embodiment comprise a processing system with a processor and memory that is coupled with respective elevator control system and a fire alarm detection system. The central control system may have various network connection couplings. The configurable model provided by the central control system allows the system to be configured using an engineering tool, for example, an off-line engineering tool that is not part of the system. However, other embodiments, may include an integrated configuration tool. Thus, the system/model can be configured on or off-line and in case of an off-line configuration, once the system is set up it can be downloaded into the actual control unit. This configured model provides for universal logic control blocks or modules within the central control system. These blocks or modules also implement all relevant legal regulation. Each module is configurable and can therefore easily be adapted to changes in the regulation or to specifics of each building. The blocks or modules are completely integrated within the control system and provide for display and manual interaction, such as keyboard, mouse, touch screen interfaces, etc. The communication with external components can be provided through dedicated communication lines, in particular digital communication lines and through a central communication bus, such as BACnet.

System configuration is particularly facilitated through the use of the control blocks or modules of the OEO control system and as mentioned above can be configured using an external engineering tool. However, configuration may also be performed directly within the system. The system may comprise an intuitive model of the building, for example, a graphical or a hierarchical tree structure, to further facilitate configuration. In particular, the system provides control blocks or modules for each building level separately and combines common functionalities in a common block or module.

In a standard implementation, only the causes for an evacuation of a building level need to be evaluated by the system. However, the modular structure of the system provides for great flexibility and, therefore, many other special situations can be addressed by the functionality of the system. The system provides, for example, on a dedicated display or a system screen, a clear representation of the structure of the building. For example, each building level is shown in its actual 'vertical' order with respect to the other levels, for example, by a respective element such as a row in a tree structure as will be explained in more detail below. The simplicity and clarity of the user interface provides for the greatest possible protection to avoid any operation, programming or configuration errors. For example a tree structure may be used to represent the building and its system which may provide for an Engineering tool used to configure the system (e.g., on a PC). According to various embodiments, such a representation is preferably designed to be self-explaining and easy to understand since a service engineer configures the OEO functions using this tool.

The distribution of the various functionalities, in particular between the elevator system and the fire alarm notification system with integrated voice evacuation provides for congruity of optical and acoustic evacuation signals. To this end, the central control system calculates and/or determines the building levels that have to be evacuated by itself and informs the elevator system accordingly. Thus, there is only a single source that provides the relevant data for an evacuation. This information source, namely the central control system, provides information to all participating units, such as elevators, alarm displays and all voice outputs. Thus, the system avoids that different applications process evacuation procedures in parallel and provide inconsistent results with respect to each other. The separate modeling of the OEO and voice allows for configuration flexibility of the voice subsystem.

In the following cases a so-called 'Phase I recall' must be activated, wherein an elevator recall also causes the elevator to be unavailable for OEO:

Fire Alarm in an elevator lobby of the group on any level of the building;

Fire in elevator shaft;

Fire in elevator machine room;

Other criteria (Mass Notification alarm, . . . ).

Specific voice messages including OEO information shall be played in the different situations; and manual activation/control of OEO must be possible, for example from a Fire Command Center.

In a Fire detection & Voice evacuation system according to various embodiments, a dedicated, intuitive SW model of the building and the OEO functionality allows for reliable, clearly arranged and manageable configuration of all OEO relevant criteria and provides the relevant states once for all involved applications. Such a functionality can be implemented within a central control unit that is coupled with existing fire detection hardware at the elevators and each floor of the building. Thus, existing communication networks can be used without requiring new communication lines to be installed within the building. Little or no additional hardware for each floor may be necessary in buildings that provide for a basic hazardous alarm system. Moreover, a single control system can be used for a variety of different types of buildings and the system is flexible to be configured to comply with various different regulations.

A Fire detection & Voice evacuation system generally is required to monitor the status of a building with respect to hazardous conditions and in case of one or more such hazardous conditions to efficiently provide means to evacuate the building. Depending on the conditions of each floor and one or more elevators, the system guides the occupants in case of, for example, a fire through the fastest exit route possible. This may include acoustic messages generated by the Voice evacuation system and visual guidance as well as the operation of elevators by the elevator system based on information provided by the Fire alarm system in the most efficient way wherein the conditions on each floor of the building may require different measurements for such an evacuation. Any of these measures may be provided by the Fire alarm system or by the Elevator system. For example, the Fire alarm system may provide for visualization of escape routes etc. (flashlights, arrows, . . . ) and/or the Elevator system may also provide for visual indication of elevator status etc. Other implementations of the visual guidance and Voice evacuation system may apply depending on the embodiment.

According to various embodiments, for each elevator group in a building, there is one control block or module per building level plus one control block or module for the common functions of the elevator group.

The system with its various blocks or modules can be seen as a model of the building with respect to the various inputs and outputs that are relevant for an OEO. Such a model incorporates all functions required by the standards and regulations and only the site-specific details need to be configured. These may include:

OEO-relevant alarm causes per building level; and

Causes for the common functions per elevator group; for example all criteria which lead to an immediate cancellation of the OEO and a 'phase I recall' of the elevators of the group.

According to various embodiments, as mentioned above, the central control unit provides for a dedicated model for the OEO and is fully integrated into the overall Fire detection & Voice evacuation system and therefore can benefit from all general functions like display and operation on operating terminals, parallel indicators etc. Furthermore, this ensures a smooth and easy inclusion of the OEO states into the configuration of the voice evacuation part.

Modelling the building within the central control system provides flexibility for the configuration of specific requirements as well as changes in the standards and regulations.

Each control block or module for a building level evaluates and provides the following states:

a) OEO alarm: an OEO relevant alarm has occurred on the building level and this building level shall be evacuated with the highest priority.

b) OEO evac: the building level shall be evacuated with OEO c) OEO unavailable: the building level should be evacuated with OEO but no elevator is available d) OEO unaffected: OEO is active within the elevator group but this level is currently not being evacuated e) OEO quiet: This means that the respective building level is in a 'quiet' state =OEO is currently not active within the group. In other words: none of the states a) . . . d) is currently active.

These various states for a building level are determined by the central control system based on information provided to the system by the various sensors located on that building level, by information determined by other building levels and information provided by the various elevator groups. States a) and b) are communicated to the elevator control. States a) and b) and additionally states c) and d) are used internally in control system according to various embodiments as a criteria for the voice evacuation control functions.

There is one supervised high-level connection, which can be provided, e.g., via the standardized Building Automation and Control Network (BACnet), for the communication of OEO states from the central control unit to the elevator system instead of a high number of hard-wired outputs. Only some additional connections which are required by the standards are hard-wired and may be required in existing system in which an OEO system according to various embodiments is to be installed.

FIG. 1 shows an exemplary building and system 100 according to various embodiments. This building may have 15 levels 0-14, wherein the bottom two levels 0 and 1 are underground. Two groups of elevators are provided, wherein each group may comprise a plurality of elevators. FIG. 1 only shows a single elevator 110 and 130 for each group. Each elevator 110, 130 may have an associated elevator control unit 115, 135 coupled with a central control unit 120. Each elevator control unit 115, 135 may be coupled through a separate dedicated communication lines 180, 190, respectively as well as a common bus, for example the BACnet bus. The communication between the elevator control units may, thus, include, for example, a BACnet bus and separate unidirectional input and output lines as will be discussed in more detail below with respect to FIG. 5. A staircase 140 may be provided which serves all building levels 0-14. Each level 0-14 may have at least one fire alarm sensor and optionally a plurality of other sensors indicated by numeral 150 coupled with the central control unit 120. Fire alarm sensors may thus, be spread at critical locations throughout the building. The elevator system may comprise separate fire alarm sensors, for example in the elevator shaft, the elevator lobby, engine room, etc. These fire alarm sensors are also connected to the fire alarm system, even though they specifically protect/monitor parts/location of the elevator system. Furthermore, each level 0-14 may have an evacuation indication system 160 coupled with the central control unit 120 via either a bus or dedicated lines 170. All communication busses may be configured in a ring form for maximum redundancy as indicated by the dotted lines. The evacuation indication system 160 may for example include a voice evacuation system, such as a PA system with speakers distributed around the respective building level, and optionally also a light indication system and/or any other means distributed around the level for guiding the occupants of that level in case of an emergency.

Depending on an existing infrastructure of a building, the OEO system can be added without or with little additional hardware. For example, building 105 as shown in FIG. 1 would provide for the essential sensors and control units. If additional sensors in specific areas of each level are necessary, they can be added and if possible existing connection to the central control unit can be used.

The central control unit 120 may be expanded by additional hardware such as a OEO control unit. In some cases, an existing central control unit may have enough processing capacity to add the functionality of an OEO unit according to various embodiments.

The OEO unit according to various embodiments generates a model of the entire building with respect to input and output values that are relevant in case of an emergency. Thus, the model generates automatically all dependencies between the various levels and their respective conditions and provides for an adapted evacuation operation.

Figure 2:
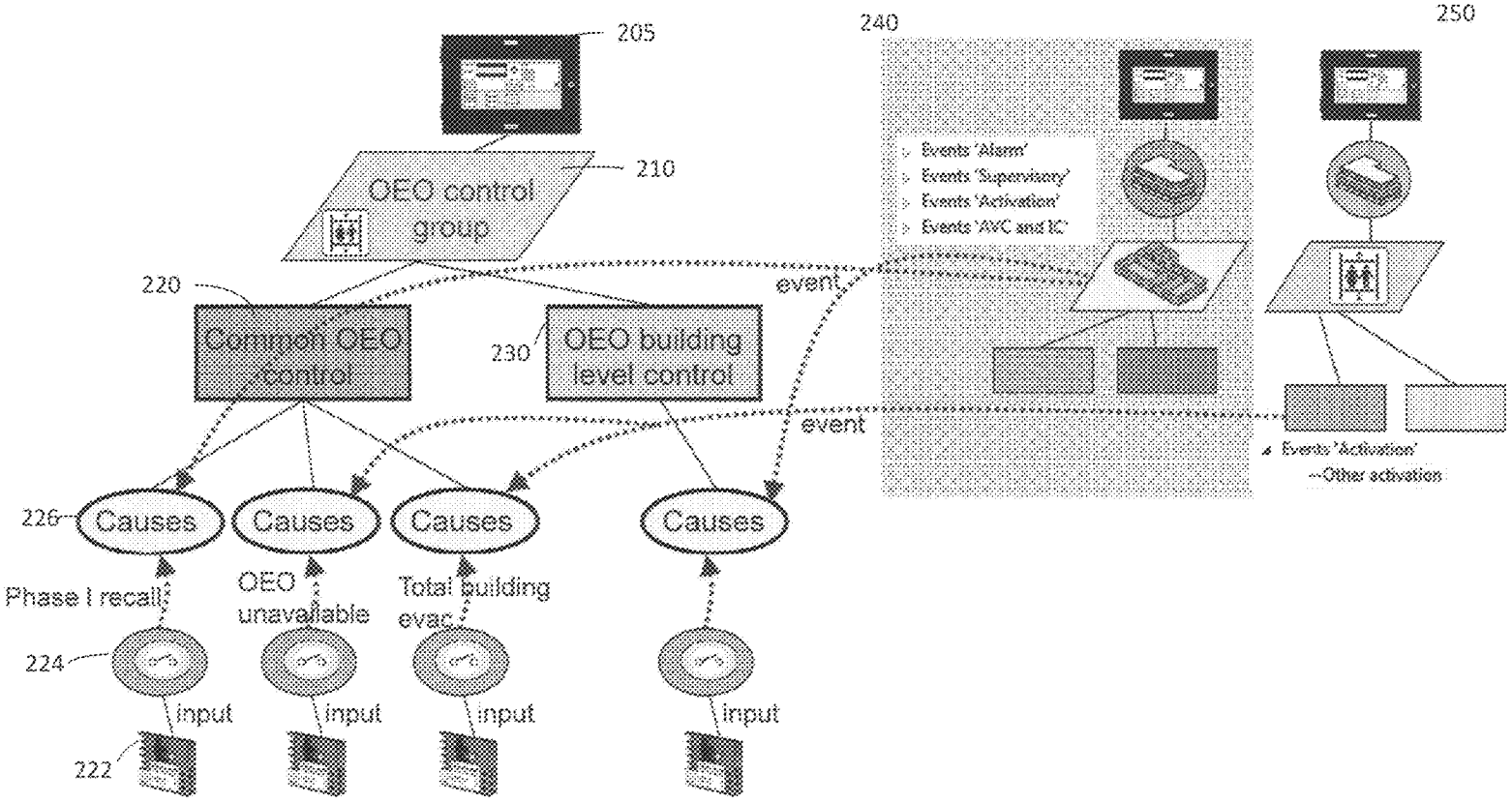
FIG. 2 shows a block diagram of a software model according to various embodiments.

FIG. 2 shows a block diagram of main functions of the OEO unit within a central control system. The OEO unit comprises various control blocks or modules that are arranged in a tree structure. Another view of the tree structure organization is shown in FIG. 3 which shows the various modules and exemplary more detailed subsections of the modules.

For example, as shown in FIGS. 2 and 3, each elevator group comprises an associated OEO control group 210. Associated with each OEO control group 210 are a common OEO control unit 220 and an OEO building level control unit 230. According to some embodiments, an OEO building level control unit 230 may serve more than one building level. The OEO control unit 220 manages common functions of the group, in other words causes that affect all elevators in that group equally. Also, the OEO building level control units 230 manage all elevators of the group. The main point of the common OEO control unit 220 is that it manages special functions for all building levels equally—without this common OEO control unit, for the respective functions the same configuration and evaluation would need to be done separately for each building level.

According to various embodiments, a "cause" as mentioned above can be seen a trigger for the system or a control element of the system to change to a specific state, which then might lead to an action or just a message, depending on the function. For example, if a "cause" occurs, the conditions for the state change are given, unless, for example, another cause-group (=other function with its causes) with higher priority is also active at the same time. A "cause" can, thus, either be a hardware input or a state of another logical element in the system. For example, "causes" can be:

- causes for 'Phase I recall' of the elevators of this group;
- cause(s) for 'OEO unavailable' state (normally reported via hard-wired input from elevator system); and
- cause(s) for 'Total building evacuation' (normally reported via hard-wired input from 'Fire command center'.

FIG. 2 further shows the fire detection module 240 which can be configured to provide input to the respective OEO building level control unit 230 and the common OEO control unit 220. According to various embodiments, the fire detection module 240 can be organized in a tree structure which models the building regarding the fire detection evaluation. Such a tree structure may have fore example the following levels:

- Area: alarm organization level.
- Section: organizational level which combines geographically or functionally related zones, typically all zones of a floor or all zones of a fire compartment.
- Zone: Has one or several devices (detectors) assigned which can be evaluated individually or in combination. This is the level that takes the alarm decision based on the signals from the devices.

Geographically, a zone typically represents a room.

Each element within the fire detection module 240 has a number of states which are reported when reached and which then can be used as causes for control functions. This is always also possible as a summarized cause on a higher level in the tree. For example, if as a cause 'alarm of a section' is assigned, then this cause is active each time a zone within the section reports an alarm.

All levels also serve as an entry point for operation functions on a person machine interface (PMI) of the fire detection module 240.

Reference symbol 250 provides output signals from other OEO control group (similar to control group 210) for another elevator group within the building. Thus, OEO control group 210 receives cross reference information from other OEO control groups if multiple elevator groups are present in the building. Therefore, an occupant evacuation operation can be optimized and coordinated for the different building levels and with respect to the available elevators.

FIG. 3 shows more details of the common OEO control unit configuration screen 300 as displayed, for example, on a PC. The 'Phase I recall' control function may include a plurality of inputs that can trigger the 'Phase I recall". For example, as shown in FIG. 3, below the entry "Causes 'Phase I recall" are the various inputs listed that actually will cause such a recall. In particular, FIG. 3 shows that a mass notification alarm will trigger the 'Phase I recall'. Furthermore, a list of alarms states in specific locations are shown which will also trigger the 'Phase I recall'. In most cases these are the alarms from elevator lobbies on each building level+alarm from elevator shaft and machine room. However, other location may trigger this event.

A respective 'Phase I recall' output which is connected to the elevator system and the control function triggering the output are not shown here. The 'Common OEO control' just evaluates the OEO-related conditions for the 'Phase I recall' and then provides that information as a state+controls the OEO functions accordingly. Thus, the system generally allows to specify a variety of triggers that cause a specific event. FIG. 3 further shows, the causes 'OEO unavailable' and 'Total building evacuation' which each can be configured to receive respective hardware input signals or states from other logical elements in the system.

In general, the OEO system according to various embodiments allows for a flexible configuration wherein submodules allow configuration of common functions that affect all elevators of a group and individual building levels can be configured. As mentioned above, the OEO building level control units also manage all elevators of the group. The main point of the common OEO control unit is that it manages special functions for all building levels equally—without this common OEO control unit, for the respective functions the same configuration and evaluation would need to be done separately for each building level.

Figure 4:
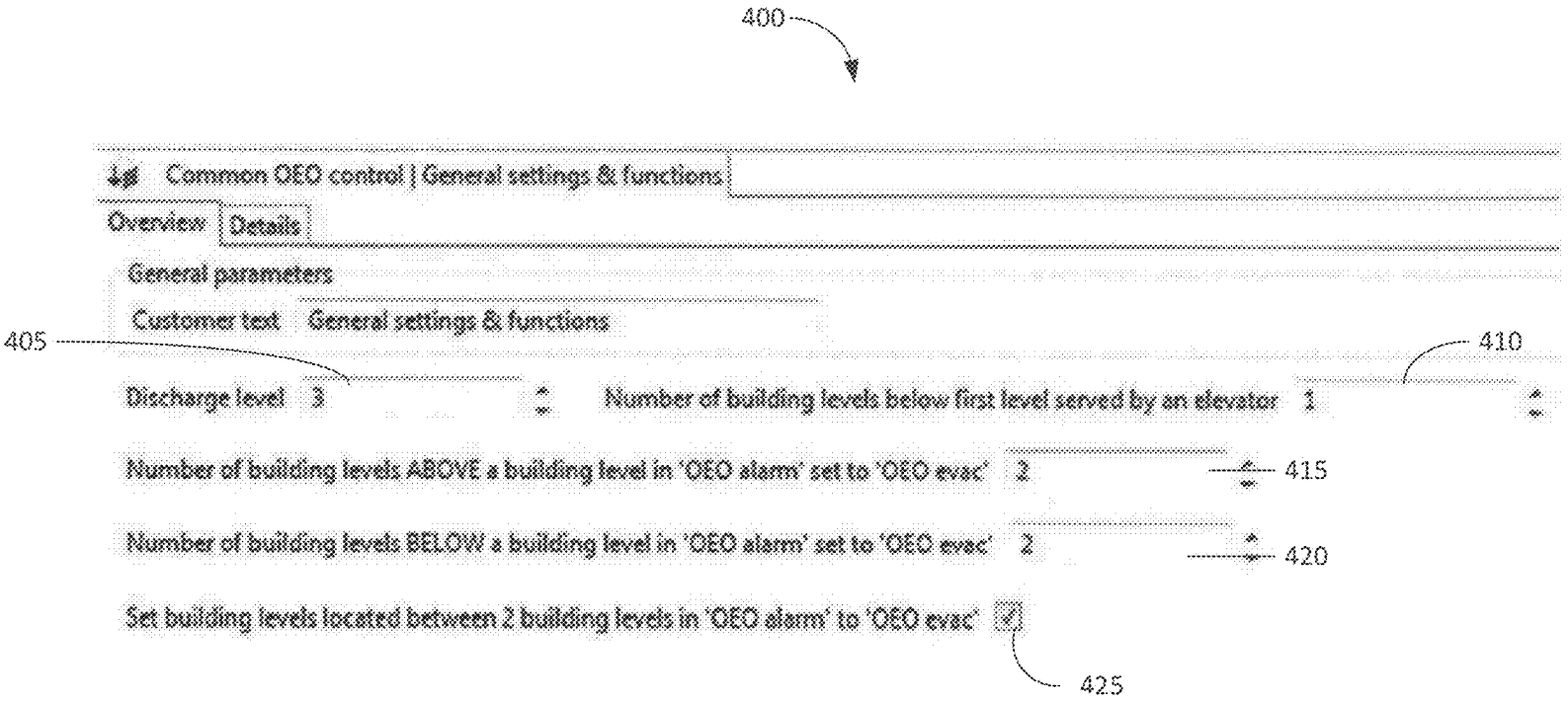
FIG. 4 shows a configuration screen according to various embodiments.

An exemplary configuration options window 400 for the setting of the behavior of the common OEO control module or block is shown in detail in FIG. 4. FIG. 2 shows this configuration window with numeral 205. This configuration window 205 may be configured to show the specific properties of the tree element 220 as it is presented in the Engineering tool which is used to configure the system. For example, this can be a configuration screen that runs on a PC. Such a configuration window allows for defining which of the various building levels is the discharge level in dialog window 405, the number of building levels below a first building level served by an elevator in window 410, the number of building levels above a building level in OEO alarm which is set to an OEO evacuation state in window 415, the number of building levels below a building level in OEO alarm which is set to an OEO evacuation state in window 420, and whether building levels located between 2 building levels in OEO alarm should also be set to an OEO evacuation state in check box 425. The discharge level is the level where people can leave the building. In many cases this is the ground level but it could also be another level. Various tree elements of the system may have associated configuration dialog windows.

As shown in FIGS. 2 and 3, one OEO building level control unit 230 may be provided per each building level. This control unit 230 receives OEO-relevant causes for the respective level. For example, FIG. 3 shows exemplary details for floor 7 including the causes assigned to floor 7. Typically, these are references to automatic alarm states of 'Section' elements in the detection tree→this element combines the logical 'Zones' of a building level or a part of a building level (e.g. fire compartment). Therefore, depending on the building structure and the detection tree defined for it, there can be one or several sections and thus one or several causes assigned to these sections.

As can be seen in FIG. 3, each building level may be configured through the configuration window 205 (FIG. 2) with respect to whether it is served by the elevator group or not. As explained above, the configuration is done with an Engineering tool, for example, on a PC and can then be downloaded to the respective target system. Reference symbol 205 shows the control unit/PMI of the target system. In addition, the configuration allows to define whether a building level is a discharge level, which is usually the ground level, allowing exiting the building. For easy orientation, the elements are arranged in ascending order with the lowest floor at the bottom.

Reference symbol 222 in FIG. 2 represents hardware inputs which are assigned to logical elements 224. The separation of these 2 element is however not critical, and may only be used for internal modeling. Generally, both combined are a cause for a function of the OEO control 220 or 230. Thus, other embodiments may directly provide an input signal to the common OEO control 220 or 230.

Figure 5:
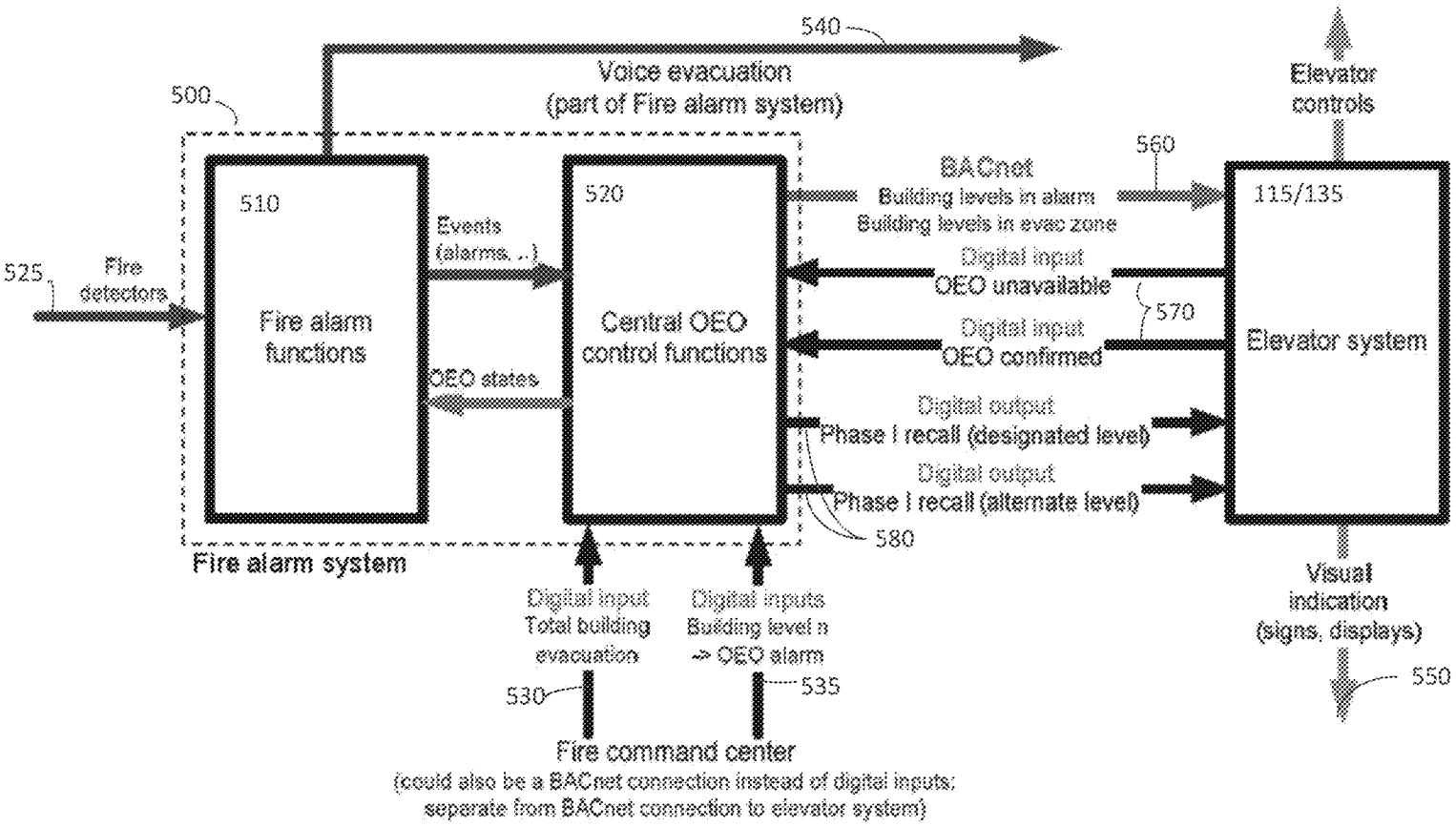
FIGS. 5, 6A, and 6B show various emergency scenarios and their associated modeling in the central control unit.

FIG. 5 shows the coupling of a Fire alarm functions 510, central OEO control functions 520 with the elevator system 115/135 and the various incoming and outgoing signals provided by the OEO system. Generally, the Fire alarm functions 510 may be provided by a distinct system separate from a central OEO system providing the central OEO control functions 520. However, according to some embodiments, in particular as shown in FIG. 5, it may be advantageous to provide for an OEO control system 500 which integrates or includes the Fire alarm functions 510 with the central OEO control functions 520. As shown in FIG. 5, the Fire alarm functions 510 provide events to the central OEO control functions 520 which feeds back OEO states to the Fire alarm functions 510. Alarms are such events which of course are most relevant in the OEO context. However, there can be also other events which could be taken into account if required, such as, for example, troubles, activations of other controls, etc. According to other embodiments, these Fire alarm functions 510 and the central OEO control functions 520 could also be implemented with separated 'Fire alarm system' and 'OEO control system', respectively.

The central Fire alarm functions 510 receives fire detection signals 525 which may be provided by individual connection lines with the fire detectors or a common bus. The central OEO control functions 520 may receive separate digital inputs for total building evacuation 530 and/or other signals 535 from each level, for example, manually initiated commands which set a specific level into status 'OEO alarm'. These input signals may also result from manual operation from a Fire Command Center. At least some of these signals may also be communicated via a higher-level communication network like BACnet. There would then be a separate logical BACnet connection (not shared with the logical BACnet connection to the elevator system). The central OEO control functions 520 can furthermore be coupled with each elevator system 115/135 which normally may consist of several elevator controllers. There can be one connection between the elevator controllers. For example, a network connection, such as BACnet 560, and individual input lines 570 and output lines 580 may be provided between control system 520 and individual elevator controllers 115/135. Each line may indicate a dedicated status as shown in FIG. 5. For example, input signals may include 'OEO unavailable', 'OEO confirmed'. Output signals may include 'Phase I recall (designated level)' and 'Phase I recall (alternate level)'. Visual evacuation signs are controlled through control signals 550 by the elevator system 115/135 based on OEO states from the Central OEO control functions 520 and further calculation by the elevator system 115/135, for example through the BACnet 560. These signs can, for example, show an elevator status information. These signs may show an actual elevator status. The Fire alarm functions 510 may also generate the respective voice evacuation signals 540 which are independent for each building level because NFPA requires that the voice messages clearly indicate the elevator availability.

Figure 6A:
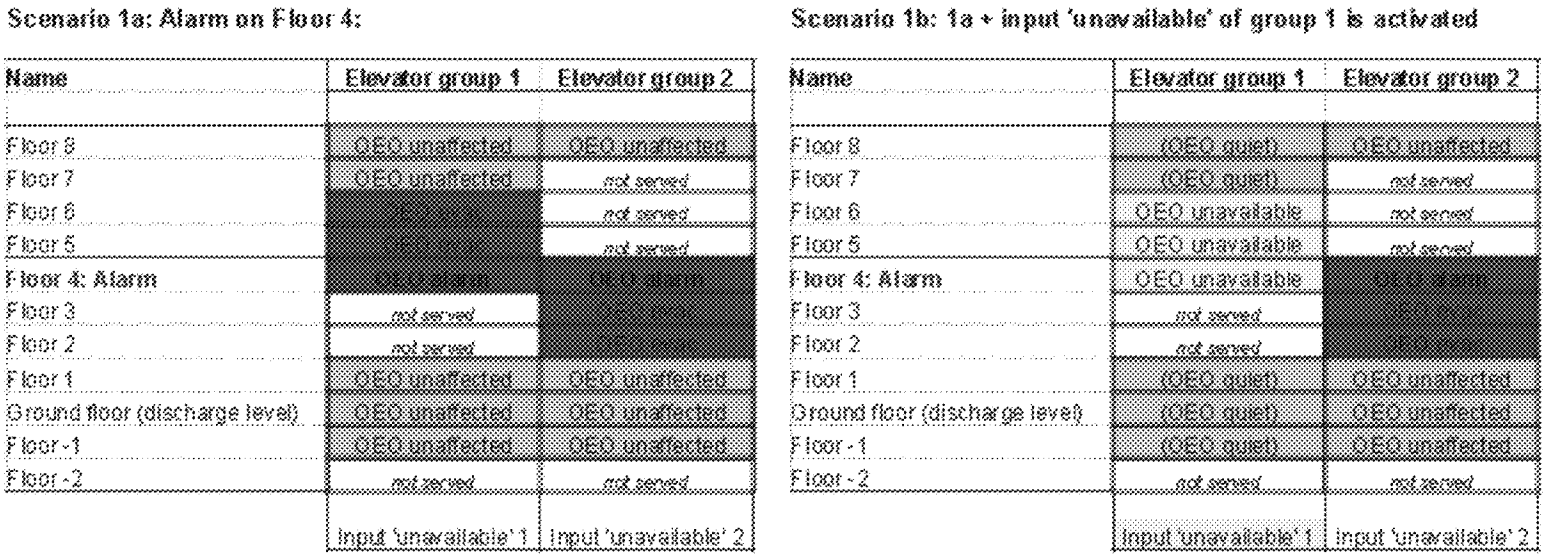
Figure 6B:
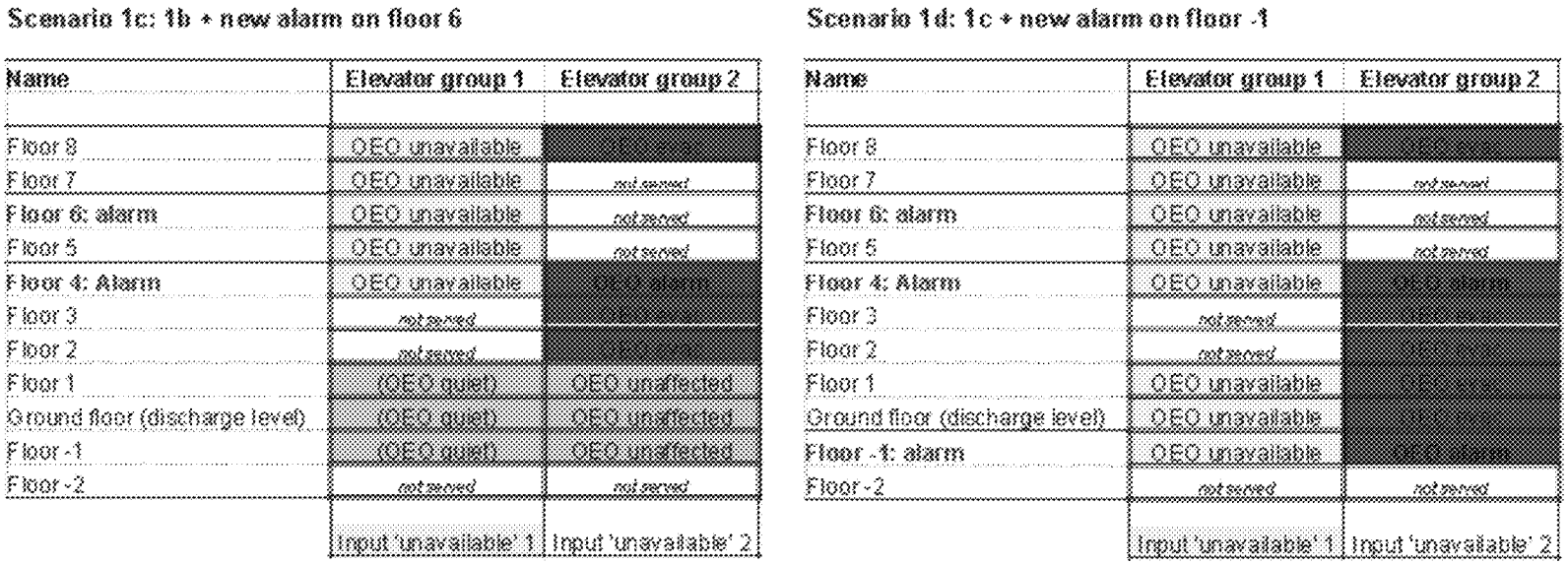

FIGS. 6A and 6B show four different exemplary scenarios of how the status of various building levels with respect to each elevator group is determined according to inputs received by the central OEO control system 500. The various scenarios relate to a building similar to the one shown in FIG. 1 using a different building level numbering. Also, the first elevator group is designed not to serve building levels −2, 2 and 3 whereas elevator group 2 is designed not to serve building levels −2, 5, 6, and 7 in this embodiment.

In scenario 1a a fire alarm has been received from building level 4. Thus, the system immediately sets level 4 for elevator group 1 and 2 into status 'OEO alarm'. As a consequence, the immediate upper two levels and the immediate lower two levels are set into status 'OEO evac'. However, for elevator group 1 this is not necessary for level 2 and 3 because they are not served by that group. Similarly, for elevator group 2, levels 5 and 6 need not to be set as they are equally not served by that group.

Scenario 1b in FIG. 6A is based on scenario 1a. However, now the elevator group 1 control unit transmitted an 'unavailable' signal to the OEO system reporting that group is not operational. Thus, the levels whose status have been previously set to 'OEO evac' or 'OEO alarm' which includes status 'OEO evac' are now set to 'OEO unavailable'. The remaining levels associated with group 1 are set to 'OEO quiet'.

Scenario 1c in FIG. 6B is based on scenario 1b. Now, an additional alarm has been received from level 6. This results for elevator group 2, in setting level 8 into 'OEO evac' and levels 7 and 8 are changed for elevator group 1 to 'OEO unavailable'.

Scenario 1d in FIG. 6B is based on scenario 1c. Now, an additional alarm has been received from level −1. This results for elevator group 2, in setting level −1 into 'OEO alarm' and ground level and level 1 also into 'OEO evac'. All served levels of elevator group 1 are now set to 'OEO unavailable'.

Based on the respective floor status as assigned to each elevator group, the central control system 500 is configured to allow the elevators to serve the levels with status 'OEO alarm' and 'OEO evac' and to send appropriate voice messages to the respective building levels. According to the requirements of NFPA, these messages must announce whether an elevator is available or not. In addition, the voice system may be controlled to announce alternative escape routes in particular when an elevator cannot serve the floor. Light signs may be activated accordingly. Due to the centralized modular control, an OEO can be well coordinated to speed up the evacuation as fast as possible.

The solution provides one single source of states which serves as a basis for all relevant applications like voice evacuation and elevator control. This allows for the highest-possible degree of consistency between the voice evacuation messages and the visual information provided to the building occupants which is crucial for a fast, reliable and secure evacuation in case of an incident.

The SW model and configuration tool as provided by the central OEO control system with its various blocks or modules allows for a well understandable, consistent and reproducible configuration of OEO relevant criteria and functions. This saves time and money due to a shorter configuration time and it greatly simplifies maintenance/update of an existing configuration by any user.

The communication of most states via one high-level connection simplifies the installation, saves money due to much lower hardware costs and improves communication quality.

What is claimed is:

1. A system for controlling and configuration of an occupant evacuation operation in a multi-story building, comprising:

an elevator control system;

a fire alarm detection system comprising a plurality of fire sensor devices, wherein the fire alarm detection system generates fire alarm information signals;

a central control system coupled with the elevator control system and the fire alarm detection system, wherein the central control system comprises a data processing system comprising a processor and memory operable to provide a configurable model of the multi-story building, to receive signals from said fire alarm detection system and to receive signals and transmit control signals from/to the elevator control system, wherein the configurable model allows configuration of the system creating a model of the functionalities in the multi-story building required for the occupant evacuation operation, and wherein the central control system controls the occupant evacuation operation (OEO) based on the signals received from the fire alarm detection system and the elevator control system, wherein the central control system provides control signals for the elevator system, wherein based on the control signals, the elevator system controls an evacuation procedure and a signage for the elevators, wherein the elevator system comprises a plurality of independently controlled elevator groups, wherein the central control system comprises at least one configurable OEO control group module related to an elevator group coupled with a common OEO control module and a plurality of OEO building level control modules.

2. The system according to claim 1, wherein the central control system comprises a network connection and the configurable model can be configured using an off-line engineering tool and is downloaded after configuration into the central control system through said network connection.

3. The system according to claim 1, wherein the signage comprises visual information.

4. The system according to claim 1, wherein the fire alarm system comprises a voice evacuation system.

5. The system according to claim 1, wherein the fire alarm system is an integrated part of the central control system.

6. The system according to claim 1, wherein the fire alarm detection system comprises fire alarm detectors for each building level.

7. The system according to claim 1, further comprising fire alarm detectors coupled with the fire alarm system and located at least in one of: an elevator engine room, an elevator shaft, and an elevator lobby.

8. The system according to claim 1, wherein the central control system is coupled with the elevator system through a BACnet network connection.

9. The system according to claim 1, wherein the central control system provides input signals to the elevator system and receives digital output signals from the elevator system.

10. The system according to claim 1, wherein the fire alarm detection system provides signals to the common OEO control module and each OEO building level control module.

11. The system according to claim 1, comprising a plurality of configurable OEO control group modules each related to one of a plurality of elevator groups, wherein each OEO control group module is further coupled with an associated common OEO control module and associated OEO building level control modules.

12. The system according to claim 11, wherein a common OEO control module associated with one of the OEO control group modules provides signals for another common OEO control module associated with another OEO control group module.

13. The system according to claim 1, wherein a configuration screen for configuring the model of the multi-story building shows configuration in a tree structure, wherein a root element represents a OEO control group module and elements representing the common OEO control module and the OEO building level control modules branch from said root element, wherein the OEO building level control modules are arranged in the tree structure showing a highest building level on the top and a lowest building level on the bottom.

14. The system according to claim 13, wherein the configuration screen allows to assign input signals to cause predefined events.

15. The system according to claim 14, wherein each module for a building level evaluates and provides the following states:

a) a first state indicating that an OEO relevant alarm has occurred on the building level;

b) a second state indicating that the building level shall be evacuated with OEO;

c) a third state indicating that the building level should be evacuated with OEO but no elevator is available;

d) a fourth state indicating that OEO is active within the elevator group but this level is currently not being evacuated; and e) a fifth state indicating none of the states a). . . d) is currently active.

16. A method for controlling and configuration of an occupant evacuation operation (OEO) in a multi-story building, comprising:

configuring a model representing the multi-story building with an engineering tool, wherein the model represents and provides configuration of all building levels and associations with at least one elevator system and control signals;

installing the configured model in a central control system coupled with an elevator control system and a fire alarm detection system within the building, wherein the central control system comprises a data processing system comprising a processor and memory operable to execute an OEO control based on the configured model, receiving signals from said fire alarm detection system and receiving signals and transmitting control signals from/to the elevator control system, wherein the central control system controls the occupant evacuation operation (OEO) based on the signals received from the fire alarm detection system and the elevator control system, generating voice evacuation messages for each building level, wherein the central control system comprises at least one configurable OEO control group module related to an elevator group and a plurality of OEO building level control modules.

17. The method according to claim 16, wherein the model comprises a common OEO control for which a plurality of input signals can be assigned to predefined events.

18. The method according to claim 16, further comprising modifying the configured model with an engineering tool to adapt the system to changes in the OEO as defined by a modified regulation or in order to adapt to changed building usage or constructional changes.

19. The method according to claim 16, further comprising providing control signals by the central control system for the elevator system, wherein based on the control signals, the elevator system controls an evacuation procedure and a signage for the elevators.

20. The method according to claim 19, wherein the signage comprises visual information.

21. The method according to claim 20, wherein the elevator system comprises a plurality of independently controlled elevator groups.

22. The method according to claim 16, wherein the fire alarm detection system comprises fire alarm detectors for each building level.

23. The method according to claim 16, further comprising arranging fire alarm detectors coupled with the fire alarm system at least in one of: an elevator engine room, an elevator shaft, and an elevator lobby.

24. The method according to claim 16, wherein the at least one configurable OEO control group module is coupled with a common OEO control module.

25. The method according to claim 24, further comprising providing signals by the fire alarm detection system to the common OEO control module and each OEO building level control module.

26. The method according to claim 24, comprising a plurality of configurable OEO control group modules each related to one of a plurality of elevator groups, wherein each OEO control group module is further coupled with an associated common OEO control module and associated OEO building level control modules.

27. The method according to claim 26, wherein a common OEO control module associated with one of the OEO control group modules provides signals for another common OEO control module associated with another OEO control group module.

28. The method according to claim 24, wherein a configuration screen for configuring the model of the multi-story building shows configuration in a tree structure, wherein a root element represents a OEO control group module and elements representing the common OEO control module and the OEO building level control modules branch from said root element, wherein the OEO building level control modules are arranged in the tree structure showing a highest building level on the top and a lowest building level on the bottom.

29. The method according to claim 28, wherein the configuration screen allows to assign input signals to cause predefined events.

30. The method according to claim 29, wherein each module for a building level evaluates and provides the following states:

a) a first state indicating that an OEO relevant alarm has occurred on the building level;

b) a second state indicating that the building level shall be evacuated with OEO;

c) a third state indicating that the building level should be evacuated with OEO but no elevator is available;

d) a fourth state indicating that OEO is active within the elevator group but this level is currently not being evacuated; and e) a fifth state indicating none of the states a). . . d) is currently active.

* * * * *